United States Patent [19]

Lavoie et al.

[11] Patent Number: 4,885,454

[45] Date of Patent: Dec. 5, 1989

[54] HIGH TEMPERATURE FURNACE FOR OXIDIZING ATMOSPHERES

[75] Inventors: Gerard H. Lavoie, Allenstown; Charles W. Miller, Jr., Gilmanton; John K. Currier, Belmont; Lionel F. Saunders, Northwood; Daniel J. Leary, Pembroke, all of N.H.

[73] Assignee: Centorr Associates, Inc., Suncook, N.H.

[21] Appl. No.: 188,499

[22] Filed: Apr. 29, 1988

[51] Int. Cl.[4] ..... H05B 3/64; F27D 11/02

[52] U.S. Cl. ..... 219/390; 219/343

[58] Field of Search ..... 219/390, 405, 411, 354, 219/546, 548, 552, 553, 343; 373/114, 127, 137, 113; 338/317, 234, 235, 236, 237

[56] References Cited

U.S. PATENT DOCUMENTS

| | | | |
|---|---|---|---|
| 1,802,892 | 4/1931 | Hansen | 373/113 |
| 3,128,325 | 4/1964 | Andersen | 219/390 |
| 3,240,915 | 3/1966 | Carter | 219/343 |
| 3,253,243 | 5/1966 | Martin | 219/552 |
| 3,406,018 | 10/1968 | Rosin | 337/137 |
| 3,443,144 | 5/1969 | Freese | 219/354 |
| 4,241,292 | 12/1980 | Kreick | 219/354 |
| 4,339,902 | 7/1982 | Cimochowski | 373/137 |
| 4,435,819 | 3/1984 | Plume | 373/137 |

*Primary Examiner*—Teresa J. Walberg

*Attorney, Agent, or Firm*—Henry D. Pahl, Jr.

[57] ABSTRACT

Tungsten heating elements are protected inside sapphire tubes which extend through an insulating shell made up of layers of successively more refractory material. Common plenums are provided at each end of the tubes and a controlled flow of a non-reactive gas is introduced into one of the plenums and is vented from the other plenum after passing through the tubes and protecting the heating elements.

4 Claims, 2 Drawing Sheets

HIGH TEMPERATURE FURNACE FOR OXIDIZING ATMOSPHERES

BACKGROUND OF THE INVENTION

The present invention relates to high temperature furnaces and more particularly to a furnace which will permit the heating of specimens to temperatures in the region of 2000 degrees centigrade in a non-neutral or oxidizing atmosphere.

While various furnace constructions are known in the art which will permit operation to temperatures approaching 2000 degrees centigrade, these designs typically require that the entire heating region be bathed in a non-reactive gaseous atmosphere such as nitrogen or argon. An example of a furnace of this type is that shown in the Anderson et al. patent 3,128,325.

Where it has been desired to heat specimens in a non-neutral or oxidizing atmosphere, prior art designs have typically provided a so-called muffle tube which surrounds the specimen or heat treatment region and which protects the heating elements from the oxidizing or reactive atmosphere. The muffle tube itself, however, tends to insulate the specimen from the source of heat and it has thus not been possible with these prior art designs to reach temperature in the region of 2000 degrees centigrade.

SUMMARY OF THE INVENTION

The present invention employs a novel arrangement of components together with critical materials selection to obtain a furnace which will heat specimens to temperatures in the region of 2000 degrees centigrade in a non-neutral or oxidizing atmosphere such as air. In the furnace of the present invention, a plurality of elongate parallel sapphire tubes, essentially coextensive in length, are distributed uniformly around a cylindrical surface which encompasses the desired heating region. Extending through each of the tubes is an elongate resistive heater, each heater having at each end a solid rod-like conductor with a filamentary or wire tungsten heating element extending between the rod-like conductors. The heating region is surrounded by an insulating shell with the tubes and the heaters extending through the shell. The shell includes selectively closable aperture means for permitting a specimen to be introduced into the heating region. A common plenum is provided at each end of the group of tubes and, within each plenum, electrical connection means are provided for applying electric current to the heaters. Conduit means are provided for introducing a controlled flow of a non-reactive gas into one of the plenums and for venting gas from the other plenum thereby to induce a protective gas flow through the tubes around each of the heating elements.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
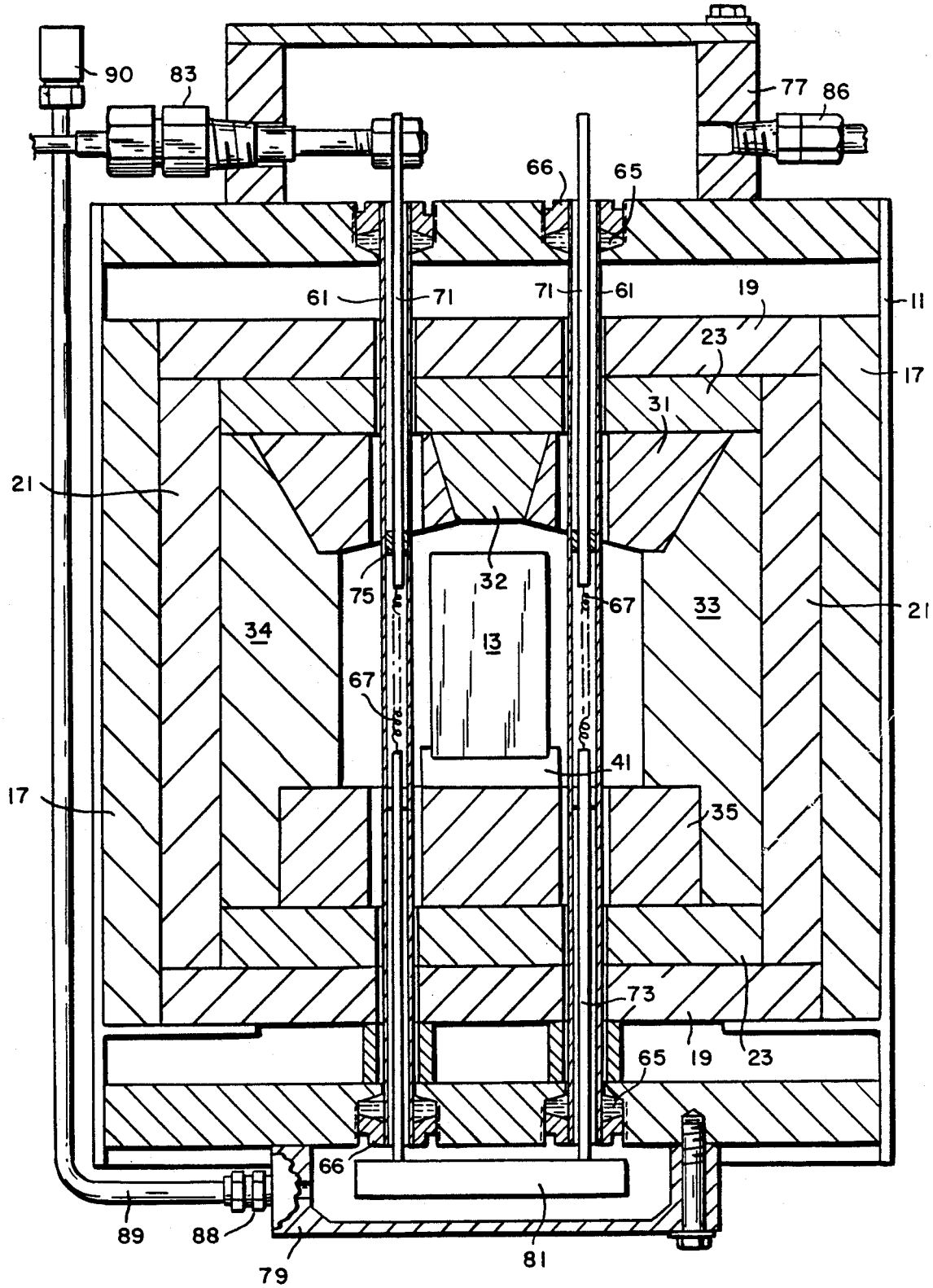
FIG. 1 is a front view, in-section, of a furnace constructed in accordance with the present invention.
Figure 2:
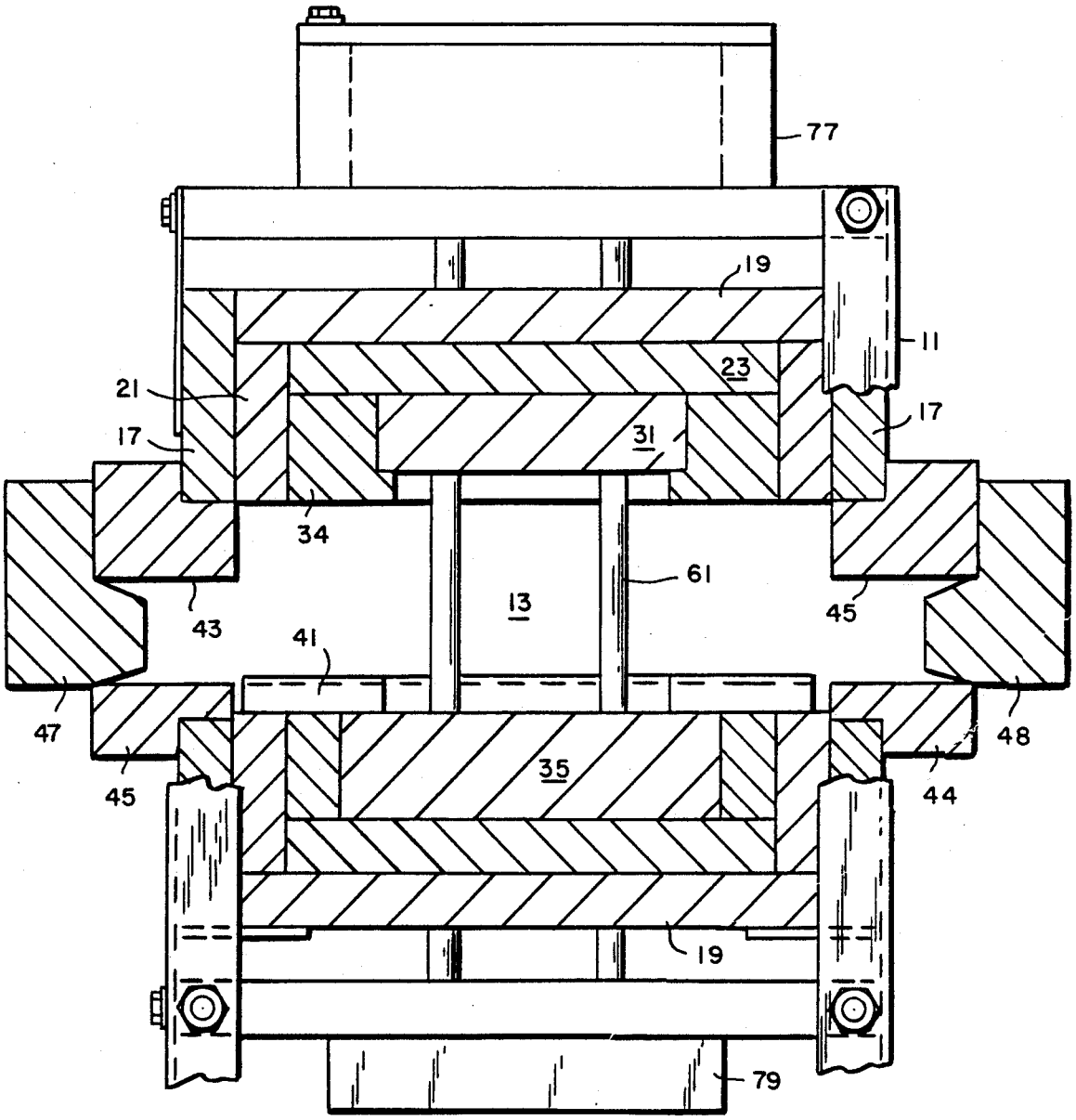
FIG. 2 is a view, also in section, of the furnace of FIG. 1.

Referring now to FIG. 1, the furnace illustrated there is built up inside a fabricated steel shell, designated generally by reference character 11. A central heating region, designated generally by reference character 13, is insulated from shell 11 by layers of insulation of successively more refractory materials. For example, the outer layer which includes side panels 17 and top and bottom panels 19 may comprise type AL-30 insulating material obtainable from Zircar Products, Inc. of Florida, N.Y. An intermediate layer which include side panels 21 and top and bottom panels 23 may be constructed of a type SALI insulating material which is also obtainable from Zircar Products, Inc. The innermost insulating layer comprises interfitting blocks of material, designated by reference characters 31–39, preferably constructed of high temperature insulating material sold under the trade name Reticel by Hi-Tech Ceramics, Inc. of Alfred, N.Y.

The insulating shell is apertured at front and back so that a specimen may be introduced into the heating region. An elongate tray 41 also constructed of Reticel is provided for sliding a specimen into or out of the heating region, insulated ports 43 and 45 being provided at either end of the passageway for access. Preferably, hinged or otherwise removable insulation plugs 47 an 48 are provided for closing off these ports during actual heating operations. Above and below the insulating shell proper are top and bottom panels 51 and 53, respectively.

Electric resistance heaters for heating the region 30 are protected inside single crystal sapphire tubes 61. Tubing of this character is available from Saphikon, Inc. of Milford, N.H. As illustrated, the tubes are essentially parallel to each other and are essentially all of the same length, i.e. they are coextensive with each other. The tubes are distributed essentially uniformly around the heating region, that is, they lie on a conceptual cylindrical surface surrounding the heating region 13. In a particular embodiment of the invention constructed as shown in the drawings, the tube 61 had an outer diameter of 0.375 inches, an inner diameter of 0.312 inches and were 12 inches long. The spacing or clearance between the tubes was 2 inches.

The successive layers of the insulating shell are apertured so that the sapphire tubes 61 can pass therethrough with slight clearance. At the top and bottom panels 51 and 53, the tubes are supported and aligned by grafoil rings 65 set in recesses in the respective panels. The grafoil rings permit axial expansion of the tubes during heating.

An electric resistance heater extends through each of the sapphire tubes 61. The portion of each heater adjacent the heating region comprises several strands or filaments of helically configured tungsten wire. The ends of the tungsten wires 67 are welded to upper and lower molybdenum rods 71 and 73, respectively. Adjacent the heating region 13, the conductor rods are roughly centered within the sapphire tubes 61 by ceramic bushings 75. The bushings are slightly smaller than the inner diameter of the tubes 61 both to accommodate expansion and to permit an axial gas flow as described hereinafter.

A common plenum structure 77 is provided above the upper ends of the sapphire tubes 61, the conductor 71 extending up into this space. Similarly, a common plenum structure 79 is provided around the lower ends of the tubes 61 with the lower ends of the conductors extending into this space.

The four heaters are connected electrically in series by means of a pair of crossbars 81 at the lower end of the conductors and by a crossbar 82 connecting two of the heaters within the upper plenum structure 77. Electrical connection is made to the endones of the series connected heaters by means of electrical feedthrough connectors 83 which pass through the upper plenum structure 77.

A port 85 and conduit connector 86 on the upper plenum structure 77 provide a means for introducing a controlled or metered flow of a non-reactive gas such as argon into the plenum. As the plenum 77 is essentially closed except for the upper ends of the sapphire tubes 61, gas introduced through the port 85 will pass down through these tubes. The lower plenum structure 79 is provided with a port 87 and conduit connector 88 for permitting release of gas flow from this plenum region. Port 87 is preferably connected through tubing 89 with a relief valve 90 which opens at a predetermined pressure to permit venting but blocks any reverse flow of air into the tube plenum structure.

In operation of the furnace, a continuous small flow of a non-reactive gas such as argon is metered into the upper plenum 77. This gas flow surrounds and protects the tungsten wire heating elements 67 as is flows down through the sapphire tubes 61. The sapphire tubes are highly transmissive to infrared radiation and thus permit a very tight thermal coupling between the heating elements and a specimen placed in the heating region 13. The tungsten heating elements have a quite high specific power output and, with the construction illustrated, this power output is relatively efficiently coupled to the specimen. Using the construction illustrated, a temperature of 1980 degrees C has been sustained for 500 hours without burning out any of the tungsten wire heating elements. It can thus be seen that the construction is relatively robust considering the very high temperatures involved.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Apparatus for heating specimens to temperatures in the region of 2000 degrees C in a non-neutral atmosphere, said apparatus comprising:

a plurality of elongate, parallel sapphire tubes which are essentially coextensive in length and are distributed uniformly around a heating region located generally centrally along the lengths of said tubes;

within each of said tubes, an elongate resistive heater, each heater having at each and an elongate solid rod-like conductor with a filamentary tungsten heating element between said rod-like conductors, said heating elements forming a means for heating said region;

surrounding said region, an insulating shell, said tubes and the rod-like conductors extending through said shell, said shell including aperture means for permitting a specimen to be introduced into said region;

means forming a common plenum at each end of said tubes;

within said plenums, electrical connection means for applying electric current to said heaters;

conduit means for introducing a controlled flow of a non-reactive gas into one of said plenums and for venting gas from the other of said plenums thereby to induce a protective gas flow through said tubes around said heating elements.

2. Apparatus as set forth in claim 1 wherein there are four sapphire tubes and heaters arranged in a square.

3. Apparatus as set forth in claim 1 wherein said tubes are single crystal sapphire.

4. Apparatus for heating specimens to temperatures in the region of 2000 degrees C in a non-neutral atmosphere, said apparatus comprising:

a plurality of elongate, parallel, tubes constructed of single crystal sapphire, said tubes being essentially coextensive in length and distributed uniformly around a cylindrical surface encompassing a heating region located generally centrally along the lengths of said tubes;

extending through each of said tubes, an elongate resistive heater, each heater having at each end an elongate solid molybdenum rod-like conductor with a helical tungsten wire heating element between said rod-like conductors, said heating elements forming a means for heating said region;

surrounding said region, an insulatng shell comprising layers of successively more refractory insulating materials, said tubes and the rod-like conductors extending through said shell, said shell including aperture means for permitting a specimen to be introduced into said region;

means forming a common plenum at each end of said tubes;

within said plenums, electrical connection means for applying electric current to said heaters;

conduit means for introducing a controlled flow of a non-reactive gas into one of said plenums and for venting gas from the other of said plenums thereby to induce a protective gas flow through said tubes around said heating elements.

* * * * *